US011187232B2

(12) United States Patent
Witzel et al.

(10) Patent No.: US 11,187,232 B2
(45) Date of Patent: Nov. 30, 2021

(54) VORTEX PUMP

(71) Applicant: KSB SE & Co. KGaA, Frankenthal (DE)

(72) Inventors: Rolf Witzel, Frankenthal (DE); Jochen Fritz, Frankenthal (DE)

(73) Assignee: KSB SE & Co. KGaA, Frankenthal (DE)

( * ) Notice: Subject to any disclaimer, the term of this patent is extended or adjusted under 35 U.S.C. 154(b) by 156 days.

(21) Appl. No.: 16/471,456

(22) PCT Filed: Nov. 14, 2017

(86) PCT No.: PCT/EP2017/079120

§ 371 (c)(1),
(2) Date: Jun. 19, 2019

(87) PCT Pub. No.: WO2018/114143

PCT Pub. Date: Jun. 28, 2018

(65) Prior Publication Data

US 2021/0131438 A1 May 6, 2021

(30) Foreign Application Priority Data

Dec. 21, 2016 (DE) ..... 10 2016 225 891.5

(51) Int. Cl.
*F04D 7/04* (2006.01)
*F04D 29/22* (2006.01)
(Continued)

(52) U.S. Cl.
CPC ..... *F04D 7/04* (2013.01); *F04D 29/2244* (2013.01); *F04D 29/24* (2013.01); *F05B 2260/604* (2013.01)

(58) Field of Classification Search
CPC ..... F04D 7/04; F04D 29/24; F04D 29/242; F04D 29/2238; F04D 29/22;
(Continued)

(56) References Cited

U.S. PATENT DOCUMENTS 3,013,501 A 12/1961 Ygge
3,267,870 A * 8/1966 Blomgren, Sr. .... F04D 29/2205 416/181
(Continued)

FOREIGN PATENT DOCUMENTS

DE 470 221 C 1/1929
EP 0 456 596 A1 11/1991
(Continued)

OTHER PUBLICATIONS

International Search Report (PCT/ISA/210) issued in PCT Application No. PCT/EP2017/079120 dated Feb. 14, 2018 with English translation (seven (7)pages).
(Continued)

*Primary Examiner* — Bryan M Lettman
(74) *Attorney, Agent, or Firm* — Crowell & Moring LLP

(57) ABSTRACT

A non-chokable pump includes an impeller having vanes for delivering solids-containing media. At least a portion of the vanes include a vane section that branches from a vane extending from a hub region of the impeller. The vane section preferably has a curvature greater than the vane extending from the hub region.

14 Claims, 5 Drawing Sheets

(51) Int. Cl.
*F04D 29/24* (2006.01)
*F04D 29/42* (2006.01)

(58) Field of Classification Search
CPC .. F04D 29/2211; F04D 29/2205; F04D 29/30; F04D 29/2244; F04D 29/245; F04D 29/2288; F04D 29/2216; F05B 2260/604
USPC ..... 416/223 B
See application file for complete search history.

(56) References Cited

U.S. PATENT DOCUMENTS

2006/0204363 A1* 9/2006 Yen ..... F04D 29/281 416/228
2010/0226773 A1* 9/2010 Bruhn ..... F04D 29/2222 416/87

FOREIGN PATENT DOCUMENTS

EP 1 616 100 B1 2/2010
JP 54-26106 U 2/1979
WO WO 2004/065796 A1 8/2004

OTHER PUBLICATIONS

German-language Written Opinion (PCT/ISA/237) issued in PCT Application No. PCT/EP2017/079120 dated Feb. 14, 2018 (five (5) pages).

* cited by examiner

VORTEX PUMP

CROSS REFERENCE TO RELATED APPLICATIONS

This application is a continuation of PCT International Application No. PCT/EP2017/079120, filed Nov. 14, 2017, which claims priority under 35 U.S.C. § 119 from German Patent Application No. 10 2016 225 891.5, filed Dec. 21, 2016, the entire disclosures of which are herein expressly incorporated by reference.

BACKGROUND AND SUMMARY OF THE INVENTION

The invention relates to a non-chokable pump having an impeller which has vanes for delivering solids-containing media.

Such non-chokable pumps are also referred to as vortex pumps, the delivery power of which is transmitted from a rotating plate provided with vanes, the so-called non-chokable impeller, to the flow medium. Non-chokable impellers are particularly suitable for delivering media mixed with solid additives, such as for example dirty water. The non-chokable impeller is a radial impeller which allows a large passage for the solids contained in the delivery medium and has a low susceptibility to faults.

A non-chokable pump for delivering liquids mixed with solid additives is described in WO 2004/065796 A1. There is a spacing between the impeller and the suction-side casing wall, in order that solid bodies can pass through the non-chokable pump without blockages. The transition from the suction-side casing wall to the wall of the casing space, which is situated radially with respect to the impeller, is realized steplessly. The casing space is of asymmetric design.

A non-chokable pump whose impeller consists of a rear shroud equipped with open vanes is described in EP 1 616 100 Bl. The vanes have different heights. A suction-side casing wall extends conically. The spacing of the casing wall to the front edges of the relatively high vanes of the impeller decreases with the diameter. A passage with a minimum extent follows a front edge of a vane of relatively low height, which vane is inclined toward the impeller outlet, in a constant manner.

A ball passage refers to a free, unrestricted impeller passage. It describes the largest permissible diameter of the solids for ensuring a blockage-free passage. It is specified as a ball diameter in millimeters. The ball passage corresponds at most to the nominal width of the suction or pressure connection piece. In order that this maximum possible ball passage is achieved in centrifugal pumps, in particular in non-chokable pumps, it is also necessary that, inside the pump, the spacing between the moved and fixed components corresponds to at least the nominal width of the suction or pressure connection piece, the ball passage otherwise being correspondingly smaller.

If the vaneless space between the vane front and the opposite casing wall exceeds a certain dimension, the efficiency of the non-chokable pump is reduced. The larger the spacing between the impeller and the suction-side casing wall, the lower the efficiency of the non-chokable pump.

It is an object of the invention to specify a non-chokable pump which is able to deliver media even having relatively large solids and which at the same time exhibits the highest possible efficiency according to the design. The non-chokable pump is intended to be distinguished by a production method which is as cost-effective as possible, and ensure a long lifetime. Moreover, the non-chokable pump is intended to be usable in as versatile a manner as possible and have low susceptibility to faults and have a favorable NPSH (net positive suction head) value. Cavitation damage is intended to be avoided.

According to the invention, the impeller vanes branch, i.e., from an origin vane section, at least one further vane section branches off. The vanes preferably extend in a curved manner from the inside outwards in a radial direction. A first vane section branches off at a branch point. As the radius increases further, further branch points may follow. In one variant of the invention, branching-off vane sections form starting points for further branches.

A cascading impeller is provided by way of the branching construction according to the invention of the vanes. By way of the branches, free spaces in which undesirable vortex formations occur, as a result of which the efficiency of the pump is reduced, are avoided. In the case of the pump according to the invention, a pump volume which leads to higher efficiency with a lower throughflow rate is provided. Owing to the branching construction, the non-chokable pump according to the invention exhibits relatively high efficiency and at the same time ensures reliable delivery of solids-containing media without blockages occurring.

In comparison with conventional non-chokable pumps with vanes which, from inside outward, become increasingly thick, the impeller according to the invention is significantly lighter. Within a vane, the construction according to the invention has spaces between the vane sections, which spaces lead to a kind of material saving. This results in a light impeller which exhibits high efficiency.

In a particularly advantageous variant of the invention, the origin vane section is joined to a hub body of the impeller. The hub body serves for the fastening of the impeller to a shaft and is formed on the rear shroud of the impeller or is formed by the rear shroud. The origin vane section is joined to the hub body and extends from the inside outward with a curvature. A first vane section branches off from a particular radius.

In a particularly advantageous variant of the invention, the first branch point is situated at the height of the run-in radius of the suction mouth, with the result that the medium flows axially through the suction mouth into a region of the impeller that is not branched at the center and then the medium is delivered radially outward into the branched regions of the vanes by the rotational movement of the impeller.

Preferably, the first branch point is situated within the first half of the vane in relation to the radial extent of the vane starting from the origin. In a particularly expedient variant, a vane section branches off in the first third of the preceding vane section, wherein it proves to be particularly advantageous if the following vane section starts in a first sub-region of the preceding vane section.

The origin vane section and all further branching-off vane sections of the vane preferably have a profile which is curved counter to the direction of rotation, forming so-called rearwardly curved vanes. Each vane projects with its individual vane sections from the rear shroud in the suction direction.

In one variant of the invention, the in each case following, branching-off vane sections have a larger curvature in comparison with the vane sections arranged in front.

In a preferred embodiment of the invention, the origin vane section and/or the in each case branching-off vane sections extend to the outer diameter of the impeller.

In a particularly expedient embodiment of the invention, the impeller is formed in one piece with the vanes. Here, it proves to be advantageous if the impeller and/or the vanes are produced from a metallic material. Preferably, use is made here of a cast material.

Spaces for dipping a ball by a particular depth are formed between the vanes. The construction according to the invention ensures a sufficient ball passage with at the same high delivery efficiency of the pump. The formation of branched vanes with in each case sufficient intermediate spaces between the vanes makes it possible for the spacing between the inflow-side casing wall and the vane front to be reduced and at the same time for a sufficient ball passage to still be ensured. Consequently, the non-chokable pump exhibits high efficiency and at the same time ensures reliable delivery of solids-containing media without blockages occurring.

In one variant of the invention, all the vanes of the impeller are formed so as to be congruent to another and have the same shape.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
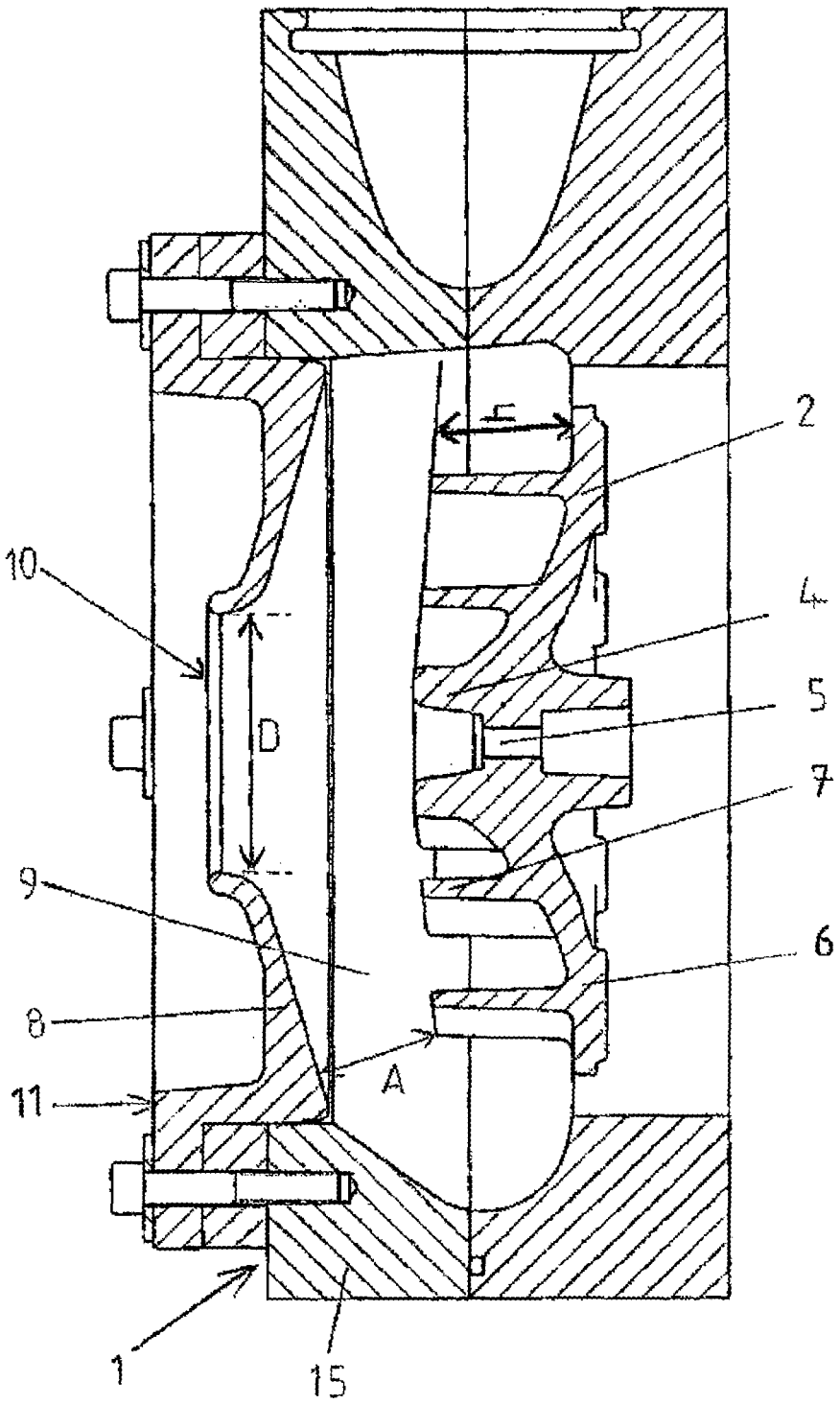
FIG. 1 shows a schematic meridional section through a non-chokable pump in accordance with the present invention.

FIG. 1 illustrates a non-chokable pump, in the casing 1 of which an impeller 2 is positioned. The impeller 2 is connected rotationally conjointly to a shaft (not illustrated in FIG. 1). A hub body 4 which has a bore 5 for screwing in a screw serves for the fastening of the impeller 2. The impeller 2 is in the form of a non-chokable impeller. Multiple vanes 7 are arranged on a rear shroud 6 of the impeller 2. A vane-free space 9 is formed between the impeller 2 and the inlet-side casing wall 8.

The suction mouth 10 is formed by a suction-side casing part 11. The suction mouth 10 forms an inlet for the solids-containing medium and has a diameter D. The suction-side casing part 11 is in the form of a suction cover.

The impeller 2 is arranged in a pump casing 15.

The front side of the non-chokable impeller 2 has, at its outer edge, a spacing A to the inner side of the suction-side casing part 11. Here, the spacing A is preferably defined as the distance which a normal, which is perpendicular to the suction-side casing wall 8, has from the outer edge of the vane front of the impeller 2. The spacing A is smaller than the diameter D.

In the FIG. 1 embodiment, the height h of the vanes 7 decreases in a radial direction, with the result that the vane front has a slightly inclined or conical profile.

Figure 2:
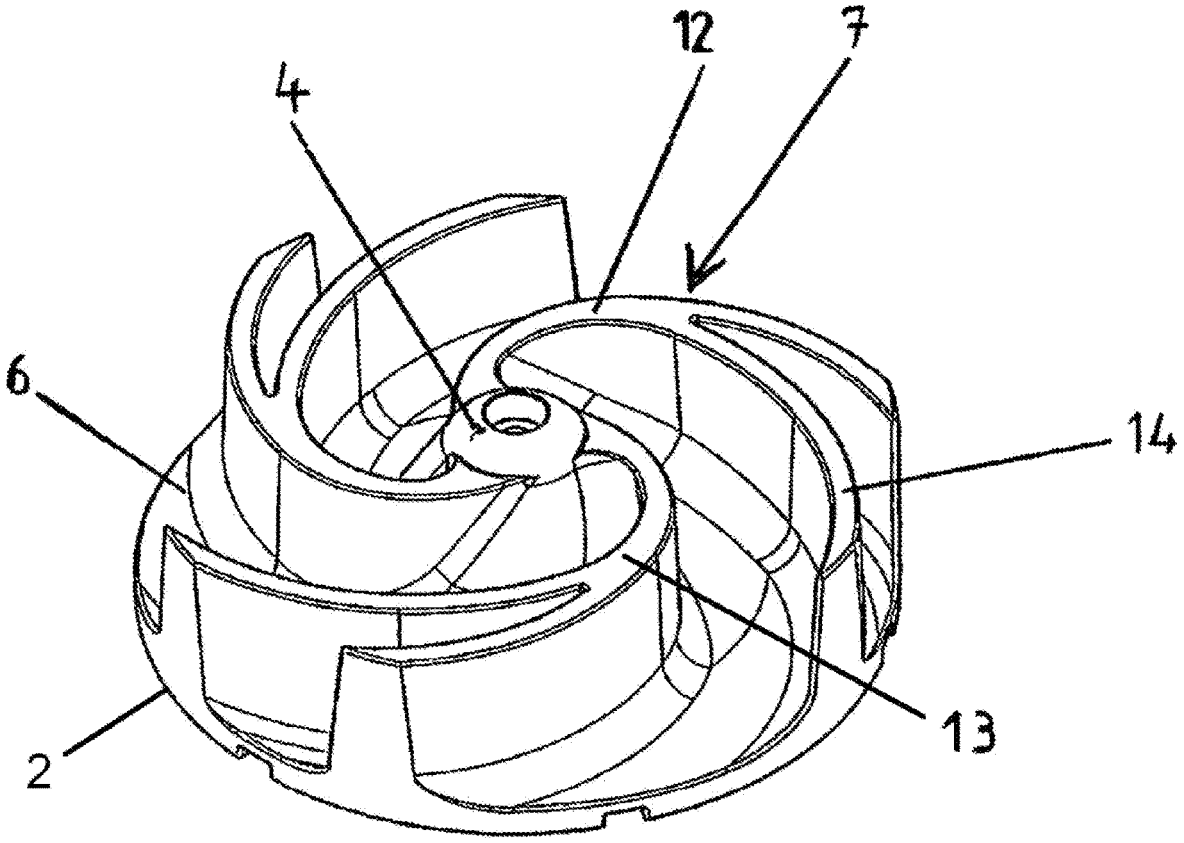
FIG. 2 shows a perspective illustration of the non-chokable impeller with three vanes of FIG. 1.

FIG. 2 shows a perspective illustration of the impeller, which is in the form of a non-chokable impeller. The impeller 2 is an open radial impeller having no cover shroud.

Three vanes 7 are arranged on the rear shroud 6. The vanes 7 are congruent. Each vane 7 has an origin vane section 12, which extends radially outward with a curvature from the hub body 4.

A vane section 14 branches off from the origin vane section 12 from a branch point 13. Both the origin vane section 12 and the branching-off vane section 14 extend to the outer diameter of the impeller 2.

The branch point 13 is situated at the height of the run-in radius 20 of the suction mouth 10, which is illustrated in FIG. 1.

The vane sections 12, 14 have a profile which is curved counter to the direction of rotation. They have a rearwardly curved profile. The branching-off vane section 14 has a larger curvature in comparison with the origin vane section 12.

Figure 3:
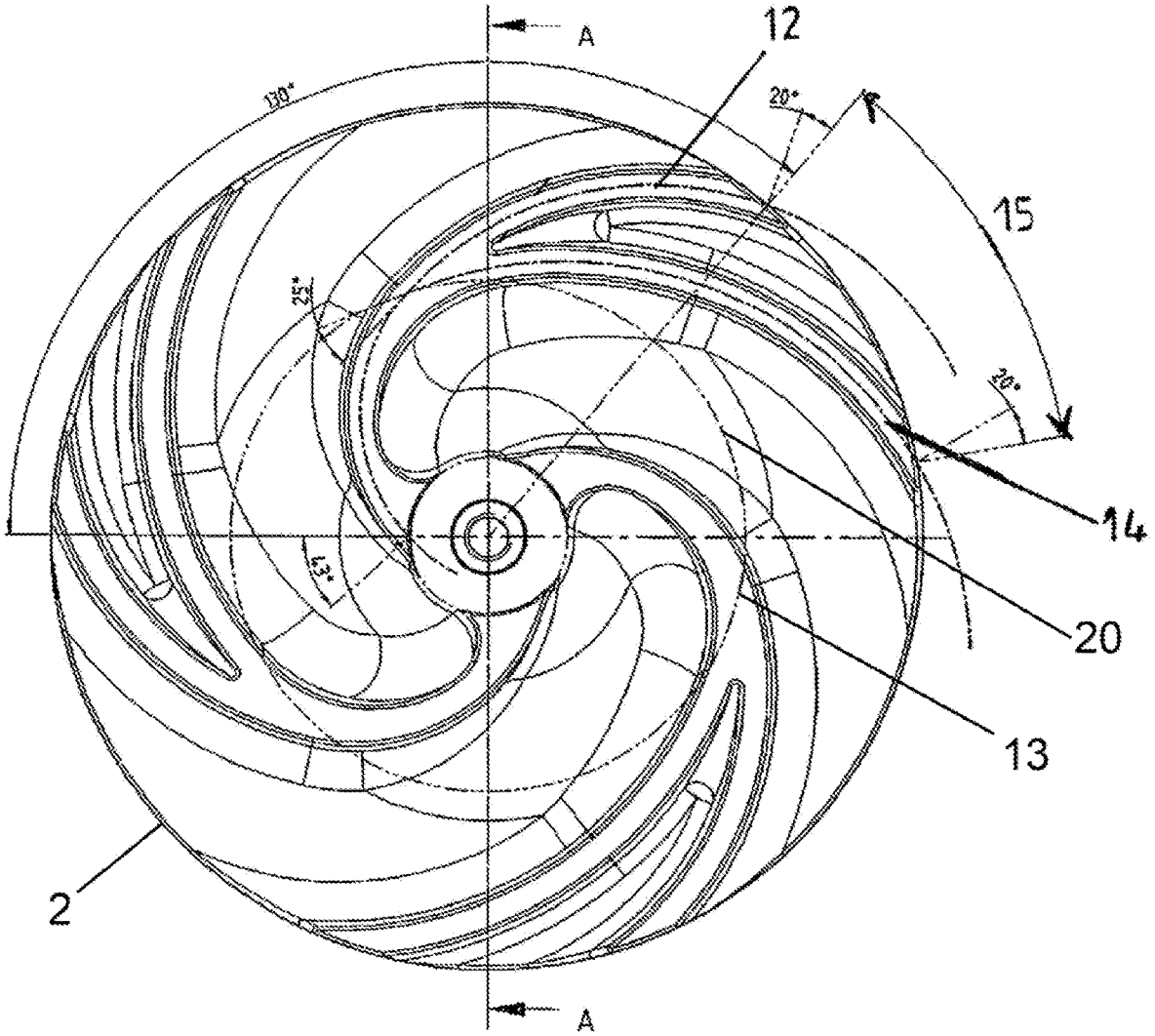
FIG. 3 shows a plan view of the non-chokable impeller of FIG. 2.

FIG. 3 shows a plan view of the impeller 2 as per the illustration in FIG. 2. The three vanes 7 are arranged offset from one another by 120°. The vane sections 12, 14 have an angular spacing 15 of 40° at the outer diameter of the impeller 2.

Figure 4:
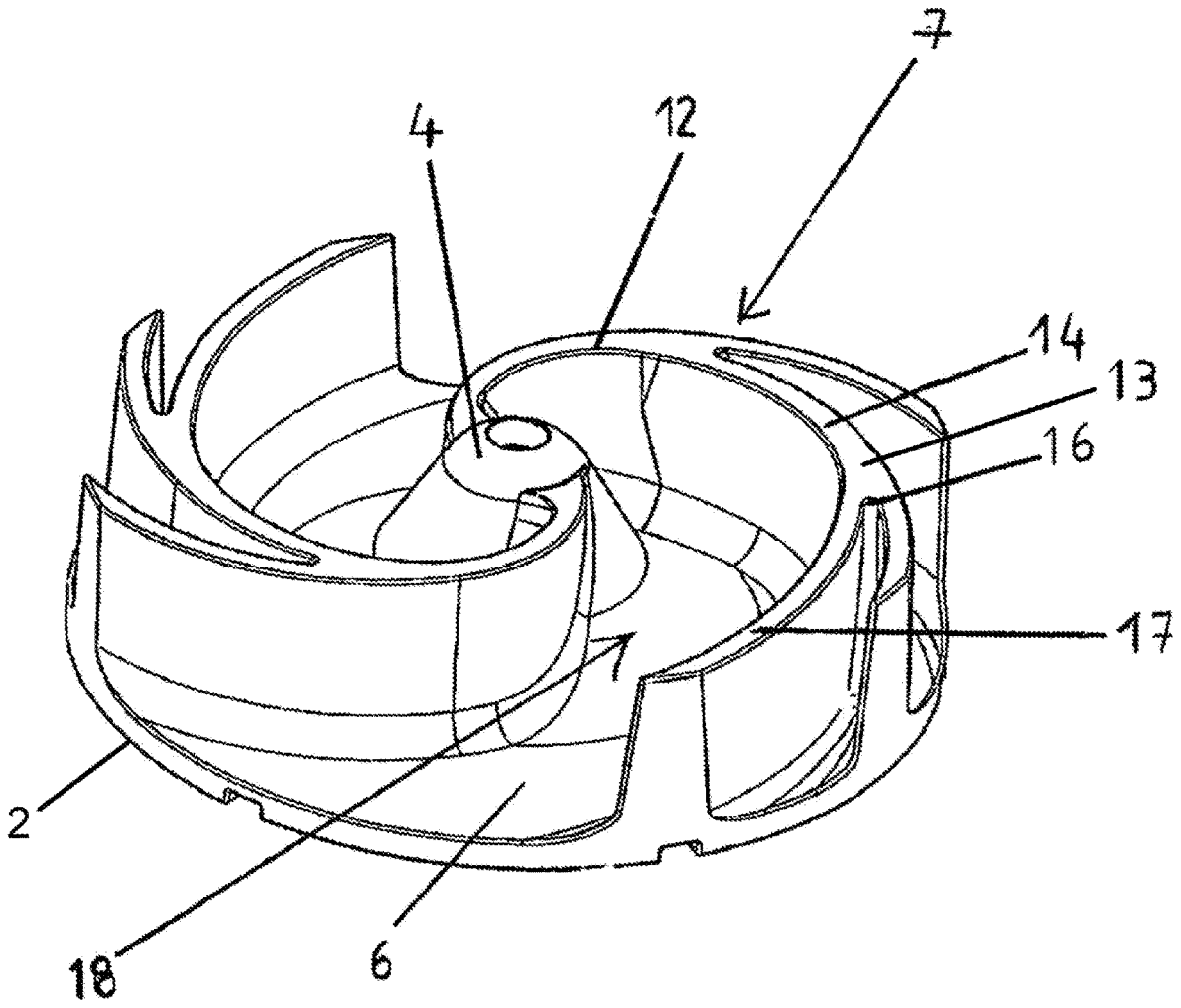
FIG. 4 shows a perspective illustration of a non-chokable impeller with two vanes in accordance with another embodiment of the present invention.

FIG. 4 shows a perspective illustration of an impeller 2, in which two vanes 7 are arranged on a rear shroud 6. The vanes 7 are arranged on the hub body 4 of the impeller 2 offset from one another by 180°. A vane section 14 branches off from the respective origin vane section 12 at a first branch point 13, from which vane section in turn there branches off a further vane section 17 from a second branch point 16. All the vane sections 12, 14, 17 extend to the outer diameter of the impeller 2.

In the FIG. 4 embodiment, the impeller 2, which consists of the rear shroud 6 with the vanes 7 and the hub body 4, is formed in one piece. It consists of a cast material. Spaces 18 for dipping a ball are formed between the vanes 7. This ensures a ball passage that ensures delivery even of solids-containing media.

Figure 5:
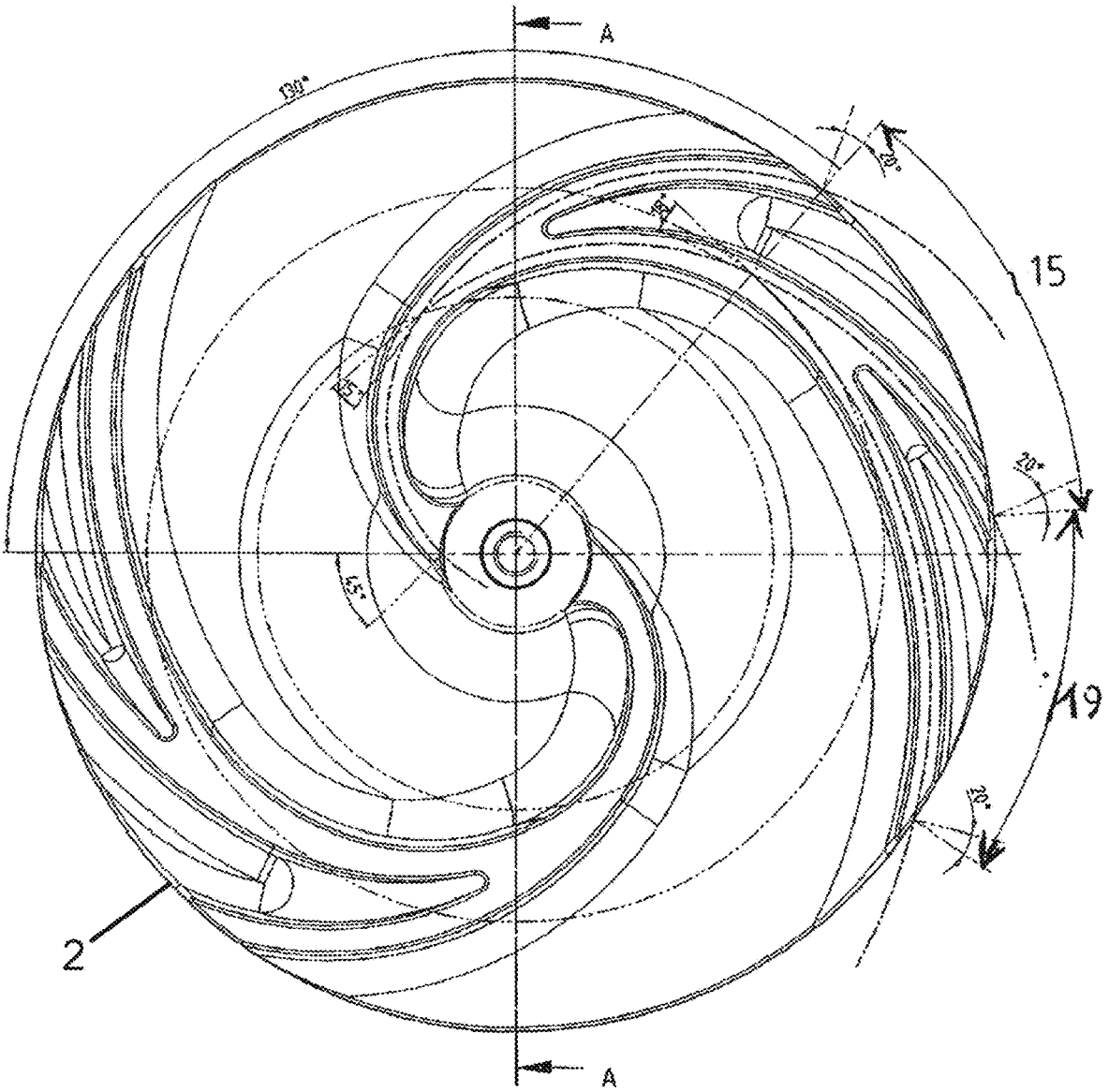
FIG. 5 shows a plan view of the non-chokable impeller of FIG. 4.

FIG. 5 shows a plan view of the impeller 2 as per the illustration in FIG. 4. The angular spacing 15 between the vane sections 12 and 14 is preferably between 30° and 60°, the angular spacing 15 being approximately 45° in the exemplary embodiment. The angular spacing 19 between the vane sections 14 and 17 is preferably between 20° and 50°, the angular spacing being approximately 38° in the FIG. 4 embodiment. The vanes 7 are arranged offset from one another by an angle of 180°.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A non-chokable pump, comprising:

a pump housing; and an impeller arranged in the pump housing, the impeller having vanes configured to deliver solids-containing media, wherein at least in a portion of the vanes, at least one vane section branches off from an origin vane section of each of the portion of the vanes, the vanes are open in a direction facing toward an opposing wall of the pump housing that contains an inlet of the non-chokable pump, an open space exists between axial upper ends of the vanes and the opposing wall of the pump housing, the open space and a circumferential gap between at least a portion of the vanes are sized such that solids in the solids-containing media which are passable axially through the inlet of the non-chokable pump are passable radially through the impeller.

2. The non-chokable pump as claimed in claim 1, wherein the origin vane section is adjacent to a hub body of the impeller.

3. The non-chokable pump as claimed in claim 2, wherein a branch point at which at least one vane section branches off from a respective vane of the portion of the vanes is located within a first half of the respective vane.

4. The non-chokable pump as claimed in claim 3, wherein the branch point is located within a first third of the respective vane.

5. The non-chokable pump as claimed in claim 3, wherein the branching-off of the at least one vane section has a larger curvature than a curvature of in comparison with the respective vane from which the at least vane section branches-off.

6. The non-chokable pump as claimed in claim 5, wherein the vanes extend to an outer diameter of the impeller.

7. The non-chokable pump as claimed in claim 3, wherein at least one further vane section branches-off from the at least one vane section that branches-off from the respective vane.

8. The non-chokable pump as claimed in claim 1, wherein the vanes have a rearwardly curved profile.

9. The non-chokable pump as claimed in claim 1, wherein the impeller is formed in one piece as a rear shroud with the vanes.

10. The non-chokable pump as claimed in claim 9, wherein the impeller is formed from a metallic material.

11. The non-chokable pump as claimed in claim 9, wherein the metallic material is a cast material.

12. The non-chokable pump as claimed in claim 1, wherein spaces configured to receive the solids-containing media are formed between the vanes.

13. The non-chokable pump as claimed in claim 1, wherein all the vanes of the impeller are congruent.

14. The non-chokable pump as claimed in claim 1, wherein the vanes extend from an origin continuously in a radial direction.

* * * * *